United States Patent [19]

Jacobsen et al.

[11] Patent Number: 4,737,274

[45] Date of Patent: Apr. 12, 1988

[54] TRAMP MATERIAL SEPARATOR

[75] Inventors: Finn Jacobsen; Rolf Ekholm, both of Karlstad, Sweden

[73] Assignee: Kamyr AB, Karlstad, Sweden

[21] Appl. No.: 882,716

[22] Filed: Jul. 7, 1986

[30] Foreign Application Priority Data

Jul. 8, 1985 [SE] Sweden ..... 8503372

[51] Int. Cl.[4] ..... B07B 1/04

[52] U.S. Cl. ..... 209/268; 209/369; 210/413

[58] Field of Search ..... 210/413–415, 210/359; 209/17, 240, 369, 250, 273, 280, 268, 380, 283, 379, 358, 271, 262, 389, 271; 241/46.06, 46.11, 46.17, 69, 70, 73

[56] References Cited

U.S. PATENT DOCUMENTS 4,231,881 11/1980 Ingermarsson .

4,543,181 9/1985 Greenwood ..... 209/273

*Primary Examiner*—Frank Sever

*Attorney, Agent, or Firm*—Nixon & Vanderhyde

[57] ABSTRACT

Effective separation of unwanted particles, such as tramp material, is effected from a paper pulp suspension (typically a medium consistency suspension, e.g. having a consistency between 5–15 percent). A generally annular opening is defined by a disc connected to a rotating shaft, and a ring stationarily mounted to a housing. The housing includes a pulp inlet, a pulp outlet, an inlet chamber, and an outlet chamber, with a separated-out particles outlet communicating with the inlet chamber, preferably extending downwardly from it. A rotating element having a plurality of generally radially extending projections, is also mounted on the shaft, adjacent the disc, and the projections cover the annular opening (radially spanning it) at spaced locations along its circumference. The projections may be teeth-like structures, or pegs, and preferably have their leading edges, viewed in the direction of rotation, sloping with respect to the radial direction. A plurality of vanes are also connected to the shaft in the outlet chamber. The shaft rotates at such a speed that fluidization of the pulp by the rotating element takes place. Not only are particles having their largest dimension equal to or greater than the radial dimension of the annular opening separated-out, but also particles that are considerably smaller than that.

20 Claims, 1 Drawing Sheet

Fig. 1
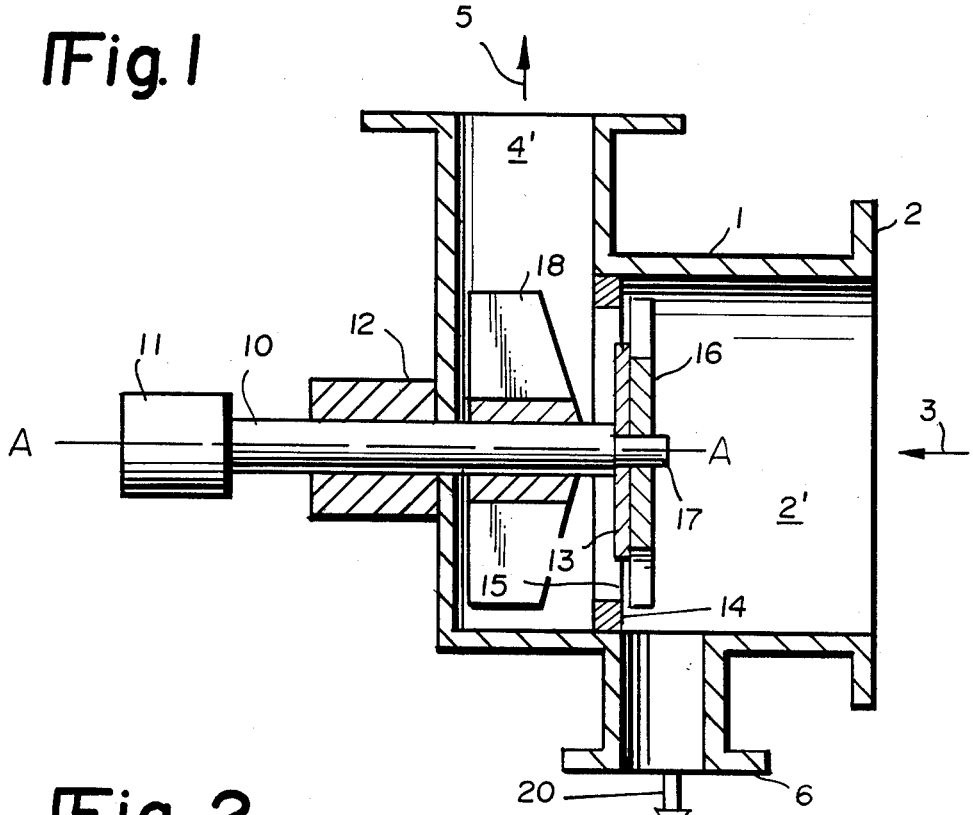
Fig. 2
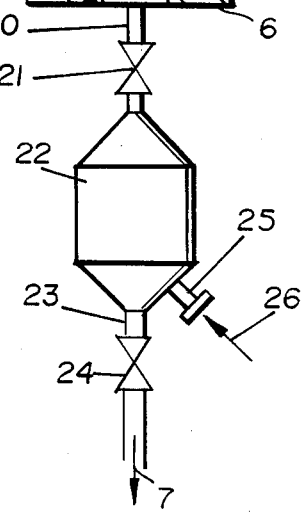
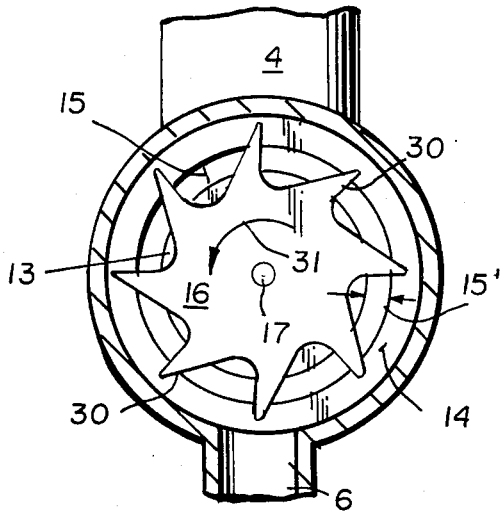
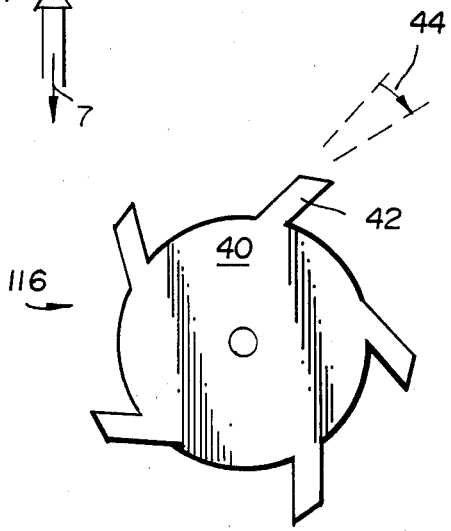
Fig. 3

TRAMP MATERIAL SEPARATOR

BACKGROUND AND SUMMARY OF THE INVENTION

Under many circumstances, it is desirable to separate particulate material out of suspensions so that the particulate material will not adversely affect equipment that acts on the suspensions. This is particularly true in the paper pulp making field, wherein the comminuted cellulosic fibrous material suspensions (paper pulp) oftentimes are contaminated by particles such as tramp metal, gravel, stones, nuts, knots, and inordinately large wood fiber bundles, or the like.

According to some known prior art procedures and apparatus for separating out such unwanted particles, an annular slot is defined through which the suspension must flow to get from the inlet to the outlet. The slot is dimensioned so that its smallest dimension is a dimension smaller than the smallest dimension of the particles to be separated out. Such devices typically are effective only at relatively low consistencies (e.g. up to about 3–4 percent), and are limited in the utility thereof to relatively larger particles for effective separation (that is the dimensions of the slot can be made only so small without excessive clogging).

According to a method and apparatus of the present invention, it is possible to practice effective separation of unwanted particles, such as tramp metal, stones, knots, etc., from paper pulp or a like suspension, even when the suspension is at medium consistency (i.e. between about 5–15 percent, and typically about 8–12 percent). Further, according to the present invention particles can be separated from the suspension even when the largest dimension thereof is significantly smaller than the smallest dimension of the slot or opening through which the suspension must flow.

According to one aspect of the present invention, an apparatus is provided for separating unwanted particles from suspensions. The apparatus comprises: means defining a generally annular-shaped opening between the inlet chamber and the outlet chamber, the means comprising an interior element and an exterior element, both disposed between the inlet chamber and the outlet chamber. And, rotating means disposed at the annular opening, the rotating means having a plurality of surface manifestation which span the annular opening, while allowing other portions of the annular opening to remain uncovered, so that as the rotating means rotates about an axis generally perpendicular to the plane containing the annular opening, particles are separated out from the suspension and pass to the separated-out particles outlet.

According to another aspect of the present invention, an apparatus is provided which comprises: a housing having a suspension inlet, a suspension outlet, and a separated-out particles outlet, and an interior chamber communicating with the suspension inlet and an interior chamber communicating with the suspension outlet; and a transition between the chambers. A rotatable shaft mounted for rotation with respect to the housing, the shaft including a disc thereon extending generally perpendicular to the axis of rotation of the shaft, the shaft mounted within the housing so that the disc is at the transition between the chambers. Means associated with the housing for defining, with the disc, an opening extending between the chambers. And, a rotatable element having a plurality of projections extending generally radially outwardly therefrom, the element mounted on the shaft, adjacent the disc, for rotation with the shaft, and the projecting elements extending so that extend over portions, but only portions, of the opening along the extent thereof.

By practicing the method according to the invention, it is possible to provide effective separation of unwanted particles from paper pulp suspensions even if the consistency thereof is between about 5–15 percent (typically about 8–12 percent) with enhanced effectiveness. The method according to the invention comprises the steps of: acting on the suspension as it is flowing from the inlet to the outlet through the opening so that particles having as the largest dimension thereof d', which is significantly smaller than d, are separated out from the suspension flowing to the suspension outlet, in addition to particles having as the largest dimension thereof a dimension equal to or greater than d. And, discharging the separated-out particles through the separated particles outlet. Also, the method may be practiced by causing the separated-out particles to move generally downwardly toward a container; causing a small upward flow of liquid, countercurrent to the separated-out particles flow, from the container, sufficient to prevent suspension from flowing into the container, while allowing particles that have been separated-out to flow into the container. And, periodically closing off the container and flushing all of the separated-out particles therefrom.

It is the primary object of the present invention to provide for the effective separation of undesired particles from a suspension inc1uding paper pulp suspensions having medium consistencies. This and other objects of the invention will become clear from an inspection of the detailed description of the invention, and from the appended claims.

BRIEF DESCRIPTION OF THE DRAWINGS

FIG. 1 is a side schematic view, partly in cross-section and partly in elevation, of exemplary apparatus according to the present invention;

FIG. 2 is a plan view, looking in along arrow 3 in FIG. 1, of the apparatus of FIG. 1, with some portions cut away for clarity of illustration; and FIG. 3 is a detail plan view of an alternative embodiment of rotating element that may be utilized with the apparatus of FIG. 1 in place of the rotating element thereof.

DETAILED DESCRIPTION OF THE DRAWINGS

Exemplary apparatus according to the present invention, as illustrated in FIG. 1, includes a housing 1, having an inlet 2 for a suspension which flows in the direction of arrow 3, and an outlet 4 for suspension which flows in the direction of arrow 5. Also there is provided an outlet 6 for particles which have been separated out of the suspension, and which are to be discharged. Note that an inlet chamber 2' communicates with the inlet 2 and discharged particles outlet 6, while an outlet chamber 4' communicates with the outlet 4. Preferably, the housing 1 has the orientation illustrated in FIG. 1; that is, the pulp is introduced at 3 generally horizontally, is discharged at 5 generally vertically upwardly, and the discharged particles which have been separated out move generally vertically downwardly.

Various components are provided for utilization with the housing 1 which effect separation of unwanted particles from the suspension. Those structures include the rotatable shaft 10 which is rotated by a device 11 (which can be an electric motor, or any other power source), rotating about an axis A—A defined by the bearing 12 which receives the shaft 10 and mounts it for rotation. The motor 11 may have a size between 75–140 kW for conventional pulp production facilities (e.g. 500–1000 tons per 24 hour capacity), so that it is capable of fluidizing medium consistency pulp.

The separating components of the apparatus illustrated in FIG. 1 also include interior and exterior components which define a generally annular opening or slot therebetween. In the preferred embodiment illustrated in the drawings, the interior element comprises the disc 13 which is mounted to the shaft 10 for rotation therewith right at the transition between the chambers 2', 4', and the ring 14 which is stationarily mounted to the housing 1, at the transition between the chambers 2', 4'. Attention is particularly directed to FIG. 2 which shows the generally annular slot or opening 15 which is defined between the disc 13 and the ring 14, the opening 15 having as its smallest dimension the radial dimension 15'. Note that in both FIGS. 1 and 2 the radial dimension of the slot 15 has been exaggerated for clarity of illustration, but in actual practice it would be proportionately different, i.e. much narrower.

The separating structure according to the invention also includes the rotating element 16 which is connected to the shaft 10 adjacent the disc 13 (e.g. abutting it), the element 16 held onto the shaft 10 by a nut 17, or other suitable structure. The element 16 is constructed so that it has a plurality of projections (or surface manifestations) extending generally radially outwardly therefrom, such as the teeth 30. The teeth 30 are dimensioned, radially, so that they span the slot 15 at spaced points around its circumference, but do not cover the entire slot 15. As illustrated in FIG. 2, it is desirable that the element 16 rotate in the direction of rotation indicated by arrow 31 and when it rotates in this direction 31 it will be seen that the teeth 30 are sloped or slanted with respect to the radial dimension, so that if any particles are disposed between the teeth 30 when they are impacted thereby they will be moved radially outwardly, and ultimately to the discharge outlet 6.

With reference to FIG. 2, the angle B typically is between about 60°–75°, to provide for optimum outward and backward movement of undesired particles impacted by the device 16. Note also that a circle drawn connecting the roots of all of the teeth 30 has a diameter less than the diameter of the disc 13, while a circle drawn connecting the tips of all of the teeth 30 has a larger diameter than the inside diameter of the ring 14.

As seen in FIG. 1, it is also desirable to provide a plurality of vanes 18 attached to the shaft 10 in the outlet chamber 4'. The vanes impart motion to the pulp suspension, effecting pumping it out of the outlet 4.

FIG. 1 also illustrates a suitable exemplary collecting and discharge device associated with the separated-out particles outlet 6. Such a device comprises a container 22 connected by conduit 20 and valve 21 to the outlet 6, and having a conduit 23, with valve 24 therein, extending downwardly from it. Discharged separated-out particles, such as tramp metal, knots, and the like, pass in the direction indicated by arrow 7.

In utilization of separated-out particles discharge device of FIG. 1, normally the valve 21 is open and the valve 24 closed, and a flow of liquid 26 is introduced through inlet 25 generally upwardly into the container 22, countercurrent to the flow of particles into the container 22. The liquid flow is sufficient to prevent suspension from passing into the container 22, but allows the separated-out particles, which are heavier, to pass downwardly into the container 22. At intervals when the container 22 is substantially full of separated-out particles, the valve 21 is closed, the valve 24 is opened, and the separated-out particles in the container 22 are flushed downwardly out of the container by the in flowing liquid, and under the force of gravity, flowing as indicated by arrow 7.

The rotating element 16 can assume other configurations beside from that illustrated in FIG. 2. For example, one alternative construction, illustrated in FIG. 3, is indicated generally by reference numeral 116. In this embodiment a disc-like body 40 has a plurality of projections, in the form of pegs 42, extending generally radially outward therefrom. The pegs 42, like the teeth 30, cover portions, but only portions, of the annular opening 15 around the circumference thereof. The pegs 42 preferably are of a material which is flexible in the plane of rotation, as schematically illustrated by the deflection arrow 44 in FIG. 3, which deflecting/flexing action facilitates separation of the unwanted particles.

OPERATION

A typical operation of the apparatus of FIGS. 1 and 2 will now be described, assuming that the suspension being acted upon is paper pulp having medium consistency (i.e. about 5–15 percent, preferably about 8–12 percent).

The medium consistency pulp passes in the direction of arrow 3 generally horizontally into inlet 2, the inlet 2 having a significantly larger cross-sectional area than the cross-sectional area of the opening 15. The suspension flows toward the opening 15, with the suspension being impacted just before the opening 15 by the rotating element 16, which is rotating at high speed (e.g. about 1500 rpm), so that fluidization of the pulp is effected. Particles that are impacted by the teeth 30 are moved outwardly, and ultimately flow to the separated particles outlet 6, and into the container 22 countercurrent to a small flow of liquid moving upwardly from the container 22. Not only is the separating device effective for preventing particles having as the smallest dimension thereof a dimension greater than the smallest dimension (radial dimension 15') of the opening 15, but it has been found that even particles having a largest dimension considerably smaller than the smallest dimension 15' of the opening do not pass through the opening 15, being separated by the separating device and moving to the outlet 6.

The pulp that passes through the opening 15 is impacted by the vanes 18, and pumped out of the outlet 4, as indicated by arrow 5. At intervals, the valve 21 is closed, and the particles that have collected in the container 22 are flushed out of the container 22 by opening the valve 24. Then the valve 24 is closed, the valve 21 again opened, and collection of particles in the container 22 proceeds as before.

When the embodiment of FIG. 3 is utilized, the elastic nature of the pegs 42 decreases the impact against heavier particles while at the same time increasing the tendency to move particles outwardly, during elastic return of the flexible pegs 42.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An apparatus for separating unwanted particles from a fluid suspension, comprising:

a housing having a suspension inlet, a suspension outlet, and a separated-out particles outlet, and an interior chamber communicating with said suspension inlet and an interior chamber communicating with said suspension outlet; and a transisition between said chambers;

a rotatable shaft mounted for rotation with respect to said housing, said shaft mounting a rotatable disc thereon extending generally perpendicular to the axis of rotation of the shaft, said shaft mounted within said housing so that said disc is approximately at said transition between said chambers;

means associated with said housing for defining, with said disc, an opening extending between said chambers; and a rotatable element having a plurality of projections extending generally radially outwardly therefrom, said element mounted on said shaft, closely adjacent said disc, for rotation with said shaft, and said projecting elements extending sc that they extend over portions, but only portions, of the opening along the extent thereof for providing a flow area sufficiently small to separate out said unwanted particles.

2. Apparatus as recited in claim 1 wherein said means for effecting rotation of said shaft effects rotation of said shaft at a speed sufficient to fluidize the suspension.

3. Apparatus as recited in claim 2 further comprising a plurality of vanes connected to said shaft in said suspension outlet chamber for effecting pumping action of the suspension out of the suspension outlet.

4. Apparatus as recited in claim 1 wherein said rotating element with projections comprises a disc having teeth extending radially outwardly therefrom.

5. Apparatus as recited in claim 4 wherein the teeth of said element have their leading edge, in the direction of rotation, sloping relative to the radial direction, so that particles that come between the teeth are thrown outwardly.

6. Apparatus as recited in claim 1 wherein the projections have their leading edges, as seen in the direction of rotation, sloped relative to the radial direction so that particles that come in between the projections are thrown outwardly.

7. Apparatus as recited in claim 1 wherein said element having projections comprises a generally disc shaped element having a plurality of pegs extending generally radially therefrom.

8. Apparatus as recited in claim 7 wherein said pegs have the leading edges thereof sloped in the direction of rotation of the element, relative to the radial direction, so that particles that come in between the pegs are thrown outwardly.

9. Apparatus as recited in claim 8 wherein said pegs are elastic in the plane of rotation of the element.

10. Apparatus as recited in claim 7 wherein said pegs are elastic in the plane of rotation of the element.

11. Apparatus as recited in claim 1 wherein said opening is annular, and has an effective cross-sectional area significantly smaller than the effective cross-sectional area of the suspension inlet.

12. Apparatus as recited in claim 1 further comprising a plurality of vanes connected to said shaft in said suspension outlet chamber for effecting pumping action of the suspension out of the suspension outlet.

13. Apparatus as recited in claim 1 wherein said suspension inlet is generally horizontal, and wherein said separated particles outlet is generally vertically downwardly.

14. Apparatus as recited in claim 13 further comprising a container for separated particles disposed below said separated particles discharge, and further comprising means for directing a small countercurrent flow of liquid against the falling separated particles so that desired solids in the suspension do not pass into the container, and valve means for selectively closing off the container and flushing it to remove separated particles, periodically.

15. A method of acting on a suspension of comminuted cellulosic fibrous material having undesired particles therein, utilizing a separator having a suspension inlet, a suspension outlet, structure defining an annular opening between the inlet and the outlet through which suspension must pass and through which particles to be separated do not pass, the opening formed by means associated with a housing and rotatable element and having a radial dimension as its smallest dimension, d, and a separated pipe and particles outlet; said method comprising the steps of:

(a) acting on the suspension as it is flowing from the inlet to the outlet through the opening so that particles having as the largest dimension thereof d′, which is significantly smaller than d, are separated out from the suspension flowing to the suspension outlet, in addition to particles having as the largest dimension thereof a dimension equal to or greater than d; and (b) discharging the separated-out particles through the separated particles outlet.

16. A method as recited in claim 15 wherein the suspension has a consistency of between about 5–15 percent, and wherein step (a) is practiced, in part, by fluidizing the suspension at the area where it is flowing from the inlet through the opening.

17. A method as recited in claim 16 wherein step (b) is practiced by: causing the separated-out particles to move generally downwardly toward a container; causing a small upward flow of liquid, countercurrent to the separated-out particles flow, from the container, sufficient to prevent suspension from flowing into the container, while allowing particles that have been separated-out to flow into the container; and periodically closing off the container and flushing all of the separated-out particles therefrom.

18. A method as recited in claim 17 comprising the further step of, simultaneous with the practice of step (a), effecting pumping of the suspension out of the suspension outlet after it has passed through the annular opening.

19. A housing having a suspension inlet, a suspension outlet, and a separated-out particles outlet, the suspension inlet and separated-out particles outlet communicating with an inlet chamber, and the suspension outlet communicating with an outlet chamber;

means defining a generally annular-shaped opening between said inlet chamber and said outlet chamber, said means comprising an interior element and an exterior element, both disposed between said inlet chamber and said outlet chamber; and rotating means disposed at said annular opening, said rotating means having a plurality of surface manifestations which span the annular opening, while allowing other portions of the annular opening to remain uncovered, so that as said rotating means rotates about an axis generally perpendicular to the plane containing the annular opening a flow area is established which is sufficiently small so that, particles are separated out from said suspension and pass to the separated-out particles outlet.

20. Apparatus as recited in claim 19 wherein said interior element comprises a disc connected to a shaft for rotation with the shaft about the axis of rotation of said rotating means, and wherein said exterior element comprises a ring stationarily mounted to said housing; and further comprising a plurality of vanes disposed on said shaft in said suspension outlet chamber.

* * * * *